United States Patent [19]

Duys

[11] 4,310,776

[45] Jan. 12, 1982

[54] CATHODE-RAY TUBE

[75] Inventor: Andreas M. W. Duys, Eindhoven, Netherlands

[73] Assignee: U.S. Philips Corporation, New York, N.Y.

[21] Appl. No.: 94,404

[22] Filed: Nov. 15, 1979

[30] Foreign Application Priority Data

Dec. 27, 1978 [NL] Netherlands ..... 7812540

[51] Int. Cl.[3] ..... H01J 29/50

[52] U.S. Cl. ..... 313/414; 313/409; 313/412; 313/443

[58] Field of Search ..... 313/414, 409, 411, 412, 313/413, 443

[56] References Cited

U.S. PATENT DOCUMENTS

| | | | |
|---|---|---|---|
| 2,579,273 | 12/1951 | Reisner, Jr. | 313/443 |
| 2,919,381 | 12/1959 | Glaser | 313/443 X |
| 3,201,631 | 8/1965 | Gale et al. | 313/443 |
| 3,389,252 | 6/1968 | Le Poole | 313/443 X |
| 3,857,057 | 12/1974 | Barten | 313/412 |

*Primary Examiner*—Stanley T. Krawczewicz
*Attorney, Agent, or Firm*—Robert J. Kraus

[57] ABSTRACT

An astigmatic cross-over of the electron beam produced by an electron gun in a cathode ray tube is effected by a non-circular symmetrical magnetic field produced by a permanent magnet arrangement provided in the vicinity of the grid of the gun. The spot produced by the beam on the display screen of the tube has a minimum of haze surrounding it and has dimensions which do not vary substantially with potential variations at the grid.

8 Claims, 13 Drawing Figures

CATHODE-RAY TUBE

BACKGROUND OF THE INVENTION

The invention relates to a cathode-ray tube comprising in an evacuated envelope an electron gun to generate an electron beam which is focused on a target, which electron gun comprises, centered along an axis, a cathode, a grid having an aperture, and a first anode having an aperture, after which grid an astigmatic cross-over is induced in the electron beam.

Such cathode-ray tubes are used to display television pictures or are used in an oscilloscope. In such cases the target is a display screen having a phosphor layer, for example in a black-and-white display tube or in an oscilloscope tube, or having a pattern of phosphor elements luminescing in different colours in a colour display tube.

Such a tube may also be used for recording pictures. In that case the target is a photosensitive layer, for example a photoconductive layer.

In all applications the spot formed when the electron beam impinges on the target must have predetermined, generally small, dimensions and the haze surrounding the spot should be minimized.

A cathode-ray tube such as that described in the opening paragraph is known from the article "30AX Self-aligning 110° in-line color TV display" in IEEE Transactions on Consumers Electronics, Vol. CE-24 No. 3, August 1978, pp. 481–487. This article describes a triple electron gun in a colour television display tube in which the grid of each gun consists of two plates arranged against each other, one plate having a horizontal slot and one plate having a vertical slot. Through these slots the grid, in cooperation with the cathode, forms a first electrostatic quadrupole lens field, and in cooperation with the first anode, forms a second electrostatic quadrupole lens field rotated 90° with respect to the first electrostatic quadrupole field. The electron beam is focused in two focal lines by said lens fields so that the mutual repelling of the electrons (space charge repelling) becomes less than in the case of one concentrated stigmatic cross-over. The strength of the fields between the grid and the cathode and between the grid and the anode and as a result of this the shape of the spot on the display screen, however, depend on the voltage variations at the grid. Moreover, in a grid of such a construction electron emission occurs from a non-circular region of the emissive layer of the cathode, which is undesirable in a number of applications.

U.S. Pat. No. 3,217,200 disclosed a cathode-ray tube in which a thin permanent magnetic plate is mounted against the first anode of a similar electron gun. This plate maintains a strong magnetic field through the aperture in the plate of the first anode, which magnetic field is torroidal and forms a circular symmetrical magnetic lens for the electron beam. With increasing and decreasing beam current the cross-over moves away from the cathode and towards the cathode, respectively. Thus the cross-over in this magnetic lens will move along the beam axis and the focusing influence of said lens on the beam and cross-over will vary in accordance with the beam current. Because the cross-over is displayed on the display screen, changing beam currents will result in varying spot dimensions on the display screen.

SUMMARY OF THE INVENTION

It is the object of the invention to provide a cathode-ray tube of the type mentioned in the opening paragraph in which the haze around the spot is minimized, in which the shape of the spot depends only slightly on the voltage at the grid and from which emission takes place from a circular region of the emissive layer of the cathode.

According to the invention, such a cathode-ray tube is characterized in that the astigmatic cross-over is induced by a non-circular symmetrical magnetic field.

Said non-circular symmetrical magnetic field is preferably substantially a quadrupole field, the field lines of which are perpendicular to or substantially perpendicular to the electron beam.

As a result of the non-circular symmetrical magnetic field the electron beam is not focused in one point only, the cross-over. This magnetic field intensifies the convergence of the beam in one direction and weakens it in the direction perpendicular thereto. As a result of this, two focal lines occur as in the cathode-ray tube from the above-mentioned article. The space charge repelling (the repelling of the electrons mutually) in these focal lines is less than in one stigmatic cross-over. An important advantage of such a magnetic lens against or near the first grid is that the lens strength is less dependent on the voltage at this grid. Moreover, the aperture in the first grid may be circular so that electrons are emitted from a circular region of the emissive surface of the cathode. Such circular emission is attractive in a number of applications, for example in camera tubes.

A preferred embodiment of the invention is characterized in that the non-circular symmetrical magnetic field is generated by means of a plate of magnetic material, which also has an aperture, and which is secured against the grid. The plate is magnetized as a quadrupole along the edge of its central aperture so that alternately a north pole, a south pole, a north pole and a south pole are present (N-S-N-S). Before this plate is secured against the grid, it can be magnetized to the desired strength and with the desired polarity. However, it is alternatively possible to first secure the plate against the grid and to then magnetize it. In this case there is no risk that the magnetic field is modified during connection (for example by spot welding) to the grid.

A second preferred embodiment of a cathode-ray tube in accordance with the invention is characterized in that the non-circular symmetrical magnetic field is produced by means of at least two bar magnets which are secured against the grid and which extend radially away from the aperture and which are provided opposite to each other with their corresponding poles facing each other. It is possible for these bar magnets to extend to nearly the inner wall of the neck of the envelope so that the magnetization becomes simpler to perform from outside the envelope.

A third preferred embodiment of a cathode-ray tube in accordance with the invention is characterized in that four bar magnets are used which are secured against the grid and which extend radially away from the aperture and of which two face each other with their north poles and two face each other with their south poles.

A fourth preferred embodiment of a cathode-ray tube in accordance with the invention is characterized in that the grid is manufactured at least partly from magnetic material which is magnetized as a quadrupole along the edge of the aperture in the grid so that alternately a north pole, a south pole, a north pole and a south pole are present (N-S-N-S).

Since the grid is situated near the cathode it has a temperature of approximately 400° C. during operation of the cathode-ray tube. Thus a permanent magnet material should be used which maintains its magnetic properties at this temperature. Suitable materials are, for example, the materials known by the commercial names Ferroxdur and Ticonal. Many types of steel are also suitable, for example, etchable steel containing, in % by weight: 20% iron, 20% Ni, 60% copper or 56% iron, 27% chromium, 15% cobalt, 1% niobium and 1% aluminum.

BRIEF DESCRIPTION OF THE DRAWING

The invention will be described in greater detail, by way of example, with reference to a drawing in which.

DESCRIPTION OF THE PREFERRED EMBODIMENTS

Figure 1:
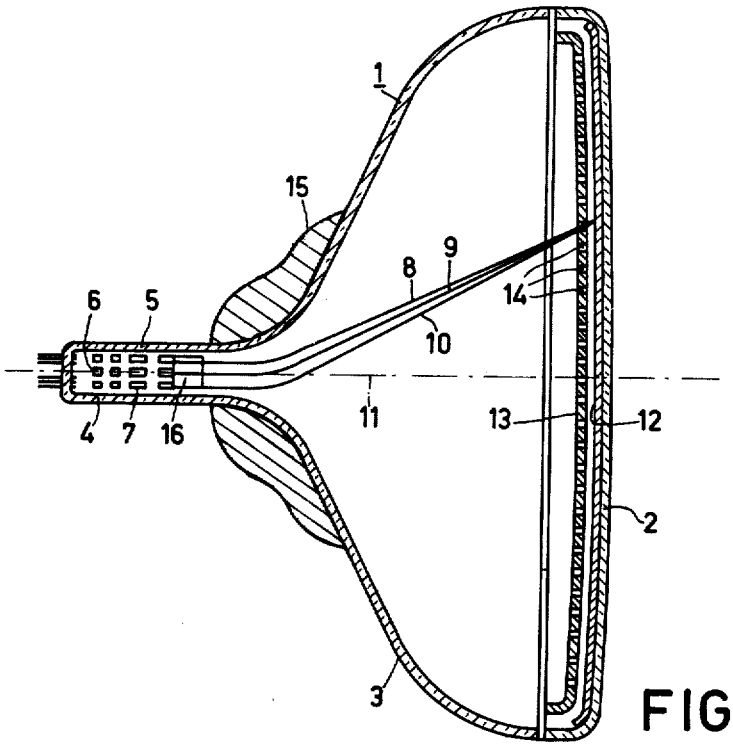
FIG. 1 is a sectional view of a cathode-ray tube according to the invention.

FIG. 1 is a diagrammatic sectional view of an exemplary cathode ray tube in accordance with the invention, comprising a colour display tube of the inline type. The tube includes a glass envelope 1 having a display window 2, a funnel-like part 3 and a neck 4. Three electron guns 5, 6 and 7 are provided in the neck for generating electron beams 8, 9 and 10, respectively. The axes of the electron guns are situated in one plane, the plane of the drawing. The axis of the central electron gun coincides substantially with the tube axis 11. The three electron guns open into a sleeve 16 which is situated coaxially in the neck 4. The display window 2 is provided on its inside with a large number of triplets of phosphor lines. Each triplet comprises a line consisting of a green luminescing phosphor, a line of a blue luminescing phosphor and a line of a red luminescing phosphor. All triplets together constitute the display screen 12. The phosphor lines extend perpendicularly to the plane of the drawing. The shadow mask 13 in which a very large number of elongate apertures 14 are provided, through which the electron beams 8, 9 and 10 pass is positioned in front of the display screen. The electron beams are deflected in the horizontal direction (in the plane of the drawing) and in the vertical direction (perpendicular thereto) by a system of deflection coils 15. The three electron guns are assembled so that the axes thereof form a small angle with each other. As a result of this the electron beams pass through the apertures 14 at said angle, the so-called colour selection angle, and each beam impinges only on phosphor lines of one colour.

Figure 2:
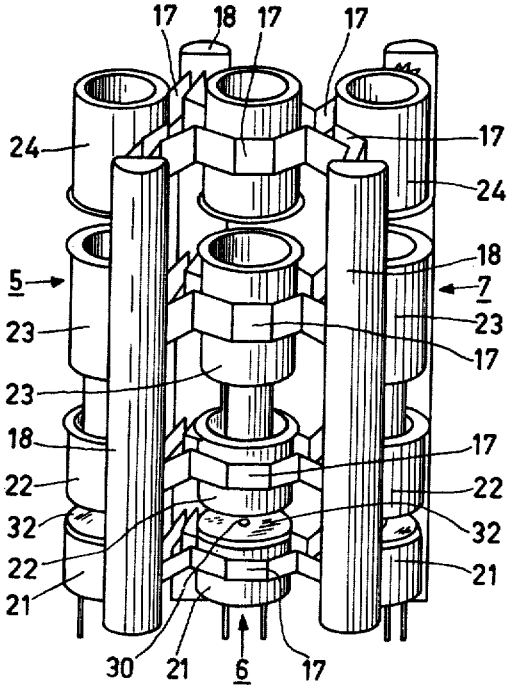
FIG. 2 shows an electron gun system for the cathode-ray tube shown in FIG. 1.

FIG. 2 is a perspective view system comprising the three electron guns 5, 6 and 7. The electrodes of this triple electron gun system are positioned relative to each other by means of metal strips 17 which are sealed in glass assembly rods 18. Each gun consists of a cathode (not visible), a grid 21, a first anode 22 and electrodes 23 and 24.

A magnetized plate 32 having an aperture 30 is provided against the grid 21. Along the edge of said aperture the plate is magnetized so that alternately a north pole, a south pole, a north pole and a south pole are present. These poles induce a quadrupole field in the aperture 30, the field lines of which extend perpendicularly to the axis of the electron beam. For the operation of the invention it is not necessary for the poles to be situated on the bisectors between the horizontal and vertical deflection directions.

Figure 3:
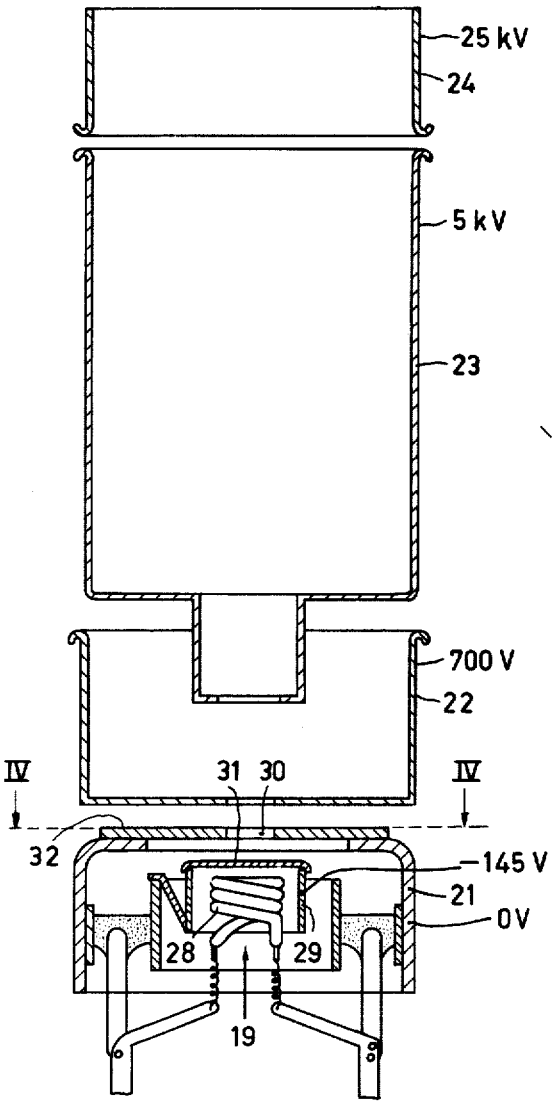
FIG. 3 is a longitudinal sectional view of one of the electron guns of the system shown in FIG. 2, FIGS. 4 to 7 show a number of possible non-circular symmetrical magnetic lenses for use in an electron gun for the cathode-ray tube in accordance with the invention.

FIG. 3 is a longitudinal sectional view of one of the electron guns. The emissive surface 31 of cathode 19 is situated opposite to aperture 30. A heating element 28 is provided in the usual manner within the cathode shaft 29. The plate 32 is magnetized as a quadrupole around the aperture 30 which is shown in FIG. 4.

Figure 4:
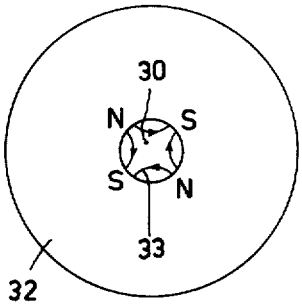

FIG. 4 is an elevation of the magnetized plate 32. Four magnet poles are provided around the aperture 30. The field lines 33 are substantially perpendicular to the axis of the electron beam. (This axis is perpendicular to the plane of the drawing).

Figure 5A:
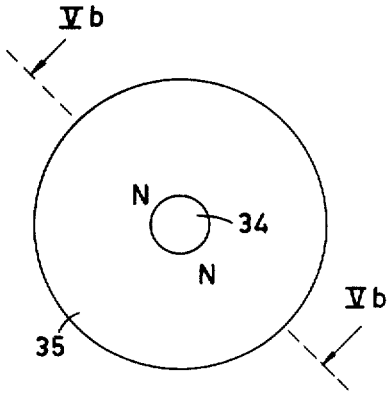
Figure 5B:
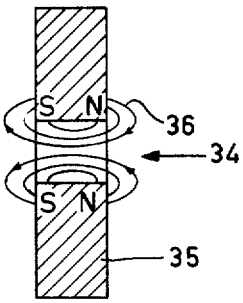

FIGS. 5*a* and *b* show another possibility of obtaining a non-circular symmetrical magnetic field in the aperture 34 of a plate 35 of magnetic material placed against the grid. Since two north poles are provided on one side of the plate 35 by magnetization and two south poles on the other side, which are situated opposite to the north poles, a non-rotationally symmetrical magnetic field is formed in the aperture 34. This field is formed by two parts of a toroidal field passing through the aperture and, the field lines 36 of which are shown.

Figure 6:
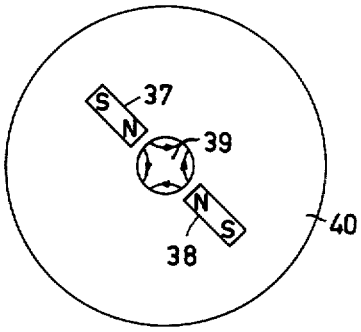

FIG. 6 shows how the non-circular symmetrical magnetic field can be obtained near aperture 39 in grid 40 by means of two bar magnets 37 and 38. The bar magnets are provided with their north poles facing each other.

Figure 7:
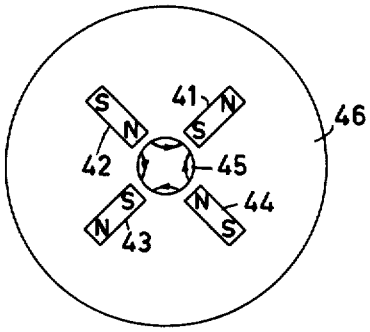

FIG. 7 shows how the non-rotationally symmetrical magnetic field can be obtained near aperture 45 in grid 46 by means of four bar magnets 41, 42, 43 and 44.

Figure 8:
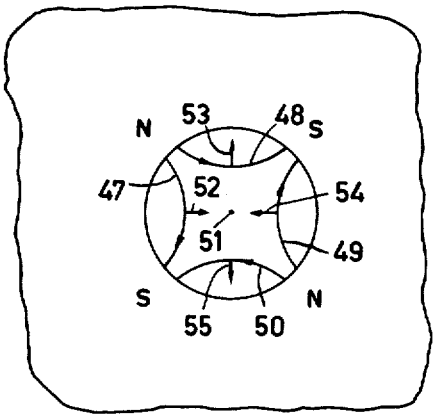
FIGS. 8 to 10 further illustrate the operation of these magnetic lenses.

According to the embodiments shown in FIGS. 4, 6 and 7 a magnetic quadrupole lens is formed in or near the aperture in the grid. The known principle of a magnetic quadrupole lens will be explained again with reference to FIG. 8. Four magnet poles, which are alternately magnetized north-sourth-north-south (N-S-N-S), constitute a magnetic field a few field, lines 47, 48, 49 and 50 of which are shown. An electron beam, the axis of which coincides with the axis of the quadrupole lens, and the electrons of which move perpendicularly-outward from the plane of the drawing, experiences the forces denoted by the arrows 52, 53, 54 and 55. As a result of this the electron beam is more weakly converged in the vertical direction than in the horizontal direction.

Figure 9:
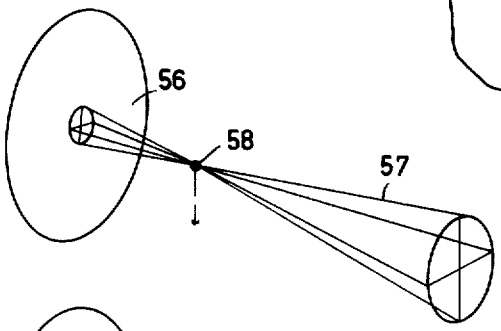

FIG. 9 shows how an electron beam 57 passing through the grid 56 would be focused in one cross-over 58 if no non-circular symmetrical magnetic lens is provided at the grid 56.

Figure 10:
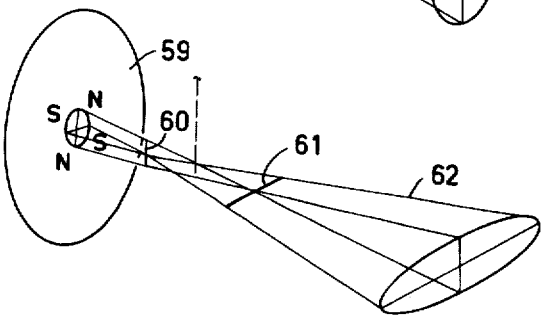

FIG. 10 shows diagrammatically how two focal lines 60 and 61 are formed in the electron beam 62 by means of the non-circular symmetrical magnetic lens in the grid 59. By the strong converging action of the magnetic lens on the electron beam in the horizontal direction, the overall focusing in the horizontal direction is obtained at the focal line 60 close to the grid. By the less strong converging action of the magnetic lens on the electron beam in the vertical direction, the overall focusing in the vertical direction is obtained at the focal line 61, further away from the grid 59.

Figure 11:
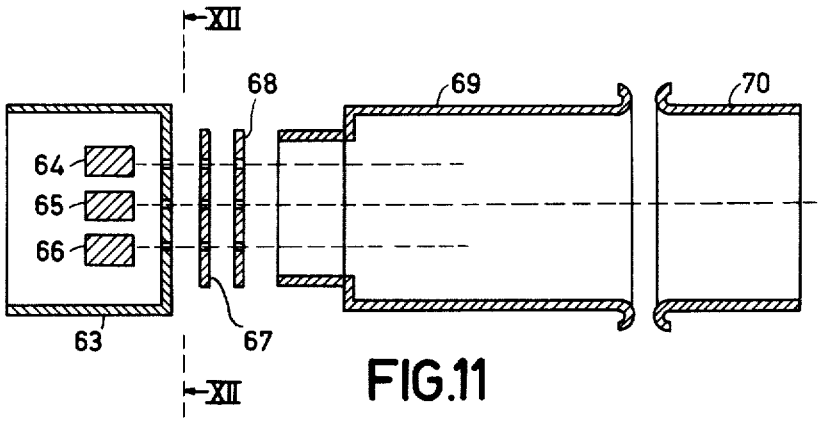
FIG. 11 is a diagrammatic longitudinal sectional view of an integrated electron gun.
Figure 12:
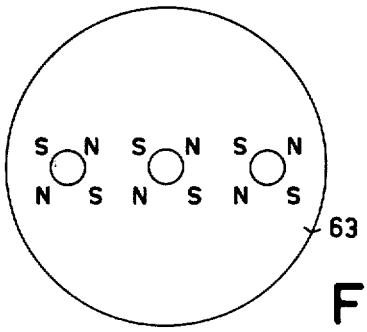
FIG. 12 is an elevation of the common grid of the electron gun shown in FIG. 11.

The invention may also be used in electron guns of the integrated type as known from U.S. Pat. No. 3,610,991. FIG. 11 is a longitudinal sectional view of such an integrated electron gun system. Three cathodes 64, 65 and 66 are assembled in a common grid 63. The first anode 67 and the electrodes 68, 69 and 70 are also common for the three integrated electron guns. The electrodes 69 and 70 together constitute the so-called main lens of the system. The common grid is manufactured from an already-mentioned steel and magnetized around each aperture in the manner shown in the elevation of FIG. 12. Each electron beam experiences the forces illustrated in FIG. 8.

Figure 13:
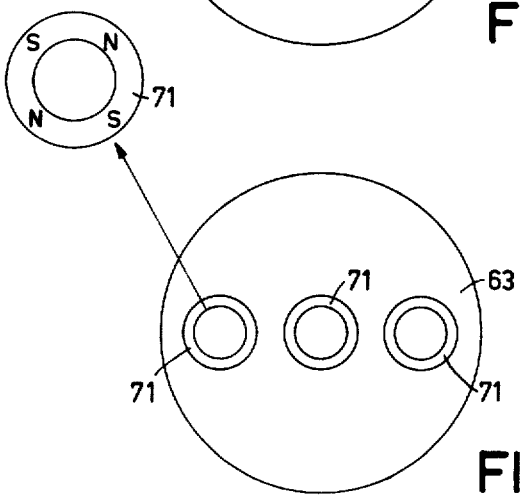
FIG. 13 shows a second embodiment of this grid.

FIG. 13 shows a second preferred embodiment of a grid as shown in FIG. 11. The grid has three rings 71 which are magnetized as a quadrupole and consist of an Fe, Co, V and Cr-alloy known by the tradename Vicalloy.

Magnetization of the non-circular symmetrical magnetic lens can be carried out in a number of manners. For example, by use of a magnetization device a strong alternating magnetic field is induced in the material to be magnetized driving the material into saturation on both sides of the hysteresis curve. Afterwards the field is decayed and permanent magnetization remains in the material which neutralizes the externally applied magnetization field and hence is oriented oppositely thereto. After switching off the magnetization device, the magnetic lens remains. The strength of the magnetic lens differs for each individual part of the electron gun and may be determined experimentally. This method is fully described in Netherlands Pat. Application No. 7,707,476 and U.S. patent application, Ser. No. 907,897 which is hereby incorporated by reference.

What is claimed is:

1. A cathode-ray tube comprising an evacuated envelope including an electron gun for generating an electron beam which is focused on a target, said electron gun comprising, centred along an axis, a cathode, a grid having an aperture, and a first anode having an aperture, characterized in that permanent magnet means is provided in the vicinity of the grid for producing a non-circular symmetrical magnetic field to effect an astigmatic cross-over of the electron beam.

2. A cathode-ray tube as in claim 1, characterized in that the non-circular symmetrical magnetic field is a quadrupole field, the field lines of which are substantially perpendicular to the electron beam.

3. A cathode-ray tube as in claim 2, characterized in that said permanent magnet means comprises an apertured plate including magnetizable material which is secured against the grid, said plate being magnetized to form a quadrupole lens such that alternate north and south poles are present along the edge of the aperture in the plate.

4. A cathode-ray tube as in claim 1, characterized in that said permanent magnet means comprises two bar magnets which are secured against the grid extending radially away from the grid's aperture and having their corresponding poles facing each other.

5. A cathode-ray tube as in claim 2, characterized in that said permanent magnet means comprises four bar magnets which are secured against the grid and extend radially away from the grid's aperture, two of said magnets facing each other with their north poles and two facing each other with their south poles.

6. A cathode-ray tube as in claim 2, characterized in that the grid is utilized to produce the non-circular symmetrical magnetic field, said grid including magnetizable material which is magnetized to form a quadrupole lens such that alternate north and south poles are present along the edge of the aperture in the grid.

7. A cathode-ray tube as in claim 2, characterized in that said permanent magnet means comprises a ring including magnetizable material which is secured against the grid around the aperture thereof, said ring being magnetized to form a quadrupole lens such that alternate north and south poles are present adjacent the aperture in the grid.

8. A cathode-ray tube as in claim 1, characterized in that said permanent magnet means comprises an apertured plate including magnetizable material which is secured against the grid, said plate being magnetized such that two north poles are provided on one side thereof and two south poles are provided on the other side situated opposite to the north poles, such that a two part toroidal magnetic field having field lines passing through the aperture in the grid is formed.

* * * * *